US009458402B2

(12) United States Patent
Takekawa

(10) Patent No.: US 9,458,402 B2
(45) Date of Patent: Oct. 4, 2016

(54) LUBRICATING OIL COMPOSITION

(71) Applicant: IDEMITSU KOSAN CO., LTD., Chiyoda-ku (JP)

(72) Inventor: Daisuke Takekawa, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/389,614

(22) PCT Filed: Mar. 29, 2013

(86) PCT No.: PCT/JP2013/059507
§ 371 (c)(1),
(2) Date: Sep. 30, 2014

(87) PCT Pub. No.: WO2013/147150
PCT Pub. Date: Oct. 3, 2013

(65) Prior Publication Data

US 2015/0051124 A1 Feb. 19, 2015

(30) Foreign Application Priority Data

Mar. 30, 2012 (JP) ..... 2012-083135

(51) Int. Cl.
*C10M 101/00* (2006.01)
*C10M 171/02* (2006.01)
*C10M 101/02* (2006.01)

(52) U.S. Cl.
CPC ..... *C10M 101/00* (2013.01); *C10M 101/02* (2013.01); *C10M 171/02* (2013.01); *C10M 2203/003* (2013.01); *C10M 2203/1025* (2013.01); *C10M 2205/028* (2013.01); *C10N 2220/022* (2013.01); *C10N 2220/023* (2013.01); *C10N 2220/025* (2013.01); *C10N 2230/02* (2013.01); *C10N 2230/06* (2013.01); *C10N 2230/08* (2013.01); *C10N 2230/43* (2013.01); *C10N 2240/04* (2013.01); *C10N 2240/042* (2013.01); *C10N 2240/044* (2013.01); *C10N 2240/045* (2013.01)

(58) Field of Classification Search
CPC ..... C10M 2203/1025; C10N 2240/042; C10N 2240/044; C10N 2240/045
USPC ..... 508/100; 208/18, 19
See application file for complete search history.

(56) References Cited

U.S. PATENT DOCUMENTS

| | | | | |
|---|---|---|---|---|
| 8,227,385 | B2 * | 7/2012 | Tagawa | C10M 101/02 208/18 |
| 8,258,087 | B2 * | 9/2012 | Yaguchi | C10M 169/04 208/19 |
| 8,349,776 | B2 * | 1/2013 | Van Houten | C10M 169/04 508/228 |
| 8,367,591 | B2 * | 2/2013 | Kamano | C10M 135/18 508/280 |
| 8,722,595 | B2 * | 5/2014 | Kamano | C10M 137/02 508/421 |
| 2007/0293408 | A1 * | 12/2007 | Opstal | C10M 169/04 508/471 |
| 2008/0096779 | A1 * | 4/2008 | Okazaki | C10M 107/02 508/459 |
| 2009/0088352 | A1 | 4/2009 | Zakarian et al. | |
| 2009/0131291 | A1 | 5/2009 | Kurosawa et al. | |
| 2009/0181871 | A1 * | 7/2009 | Shah | C10M 107/02 508/459 |
| 2010/0041572 | A1 | 2/2010 | Sano et al. | |
| 2012/0046205 | A1 | 2/2012 | Tagawa et al. | |
| 2012/0053375 | A1 | 3/2012 | Tagawa et al. | |

FOREIGN PATENT DOCUMENTS

| | | |
|---|---|---|
| EP | 2 009 083 A1 | 12/2008 |
| EP | 2 009 084 A1 | 12/2008 |
| EP | 2 428 554 A1 | 3/2012 |
| JP | 2007-284635 | 11/2007 |
| JP | 2008-13677 | 1/2008 |
| JP | 2008-13686 | 1/2008 |
| JP | 2008-13819 | 1/2008 |
| JP | 2010-90210 | 4/2010 |
| JP | 2011-174000 | 9/2011 |

OTHER PUBLICATIONS

International Search Report issued May 21, 2013, in PCT/JP13/59507 filed Mar. 29, 2013.
Shadan Hojin Nippon Junkatsu Gakkai, Junkatsu Handbook, 3rd edition, Kabushiki Kaisha Yokendo, Jun. 1, 1975, 3 pages.
Extended European Search Report issued Oct. 19, 2015 in Patent Application No. 13768022.9.

* cited by examiner

*Primary Examiner* — Ellen McAvoy
(74) *Attorney, Agent, or Firm* — Oblon, McClelland, Maier & Neustadt, L.L.P.

(57) ABSTRACT

Provided by the present invention is a lubricating oil composition having a low friction coefficient (traction coefficient) and a superior fluidity at low temperature, suitable as a transmission oil including an automatic transmission oil, by using a base oil which contains a mineral oil satisfying the conditions that (1) kinetic viscosity at 100° C. is in the range of 5 $mm^2/s$ or more to 8 $mm^2/s$ or less, (2) viscosity index is 130 or more, and (3) % $C_P$ by a ring analysis (n-d-M method) is 80 or more.

10 Claims, No Drawings

LUBRICATING OIL COMPOSITION

CROSS-REFERENCE TO RELATED APPLICATIONS

This application is a National Stage of PCT/JP2013/059507, which was filed on Mar. 29, 2013. This application is based upon and claims the benefit of priority to Japanese Application No. 2012-083135, which was filed on Mar. 30, 2012.

BACKGROUND OF THE INVENTION

1. Technical Field

The present invention relates to a lubricating oil composition, specifically a lubricating oil composition having a low friction coefficient (traction coefficient) and a superior fluidity at low temperature, suitable as a transmission lubricating oil including an automatic transmission lubricating oil.

2. Background Art

In recent years, in the lubricating oil used in a transmission including a transmission for an automobile, a lower fuel consumption than ever has been required.

To improve the fuel consumption of a lubricating oil, there have been known mainly a method in which an agitation resistance is lowered by lowering a viscosity of the lubricating oil and a method in which a frictional loss is reduced by lowering a friction coefficient in a sliding part. However, there is a limit in lowering a viscosity of the lubricating oil; and therefore, in order to further improve the energy consumption, further lowering of the friction coefficient is necessary. With regard to lowering of the friction coefficient, an evaluation method based on a traction coefficient, which is a fluid friction coefficient in an elastic fluid lubrication region, is commonly used. In other words, a lubricating oil having a further lower traction coefficient is wanted.

Besides, the lubricating oil for a transmission including an automobile transmission also needs to have a superior fluidity at low temperature because it is usually used also at low temperature in a cold weather region and the like.

As to the lubricating oil as mentioned above, in the past, for example, in Patent Document 1, as the lubricating oil having a low traction coefficient, a lubricating oil composition containing as a base oil a partial ester between a polyvalent alcohol and a carboxylic acid was proposed. However, the lubricating oil like this potentially undergoes hydrolysis so that this is difficult to be used stably for a long period of time.

Alternatively, in Patent Document 2, a proposal was made as to the lubricating oil, a blend of a mineral oil with a poly(α-olefin) having a kinetic viscosity at 100° C. in the range of 15 $mm^2/s$ or more to 300 $mm^2/s$ or less, which was produced by using a metallocene catalyst. However, the lubricating oil like this was necessary further improvement in the traction coefficient and the fluidity at low temperature.

Moreover, all of the conventional lubricating oils as exemplified above use a synthetic oil having a high viscosity; and thus, these lubricating oils become expensive. Accordingly, a lubricating oil which is relatively cheap and comprises mainly a mineral oil is expected to be realized.

Under the situation as mentioned above, a lubricating oil which has a further lowered traction coefficient, a superior fluidity at low temperature, and no fear of deterioration of the hydrolysis stability, and yet comprises mainly a mineral oil, is eagerly wanted.

Patent Document 1: Japanese Patent Laid-Open Publication No. 2010-90210

Patent Document 2: Japanese Patent Laid-Open Publication No. 2011-174000

SUMMARY OF THE INVENTION

Problems to be Solved by the Invention

The present invention has an object to provide a lubricating oil composition having a low friction coefficient (traction coefficient) and a superior fluidity at low temperature, suitable as an oil for a transmission including an automatic transmission.

Means for Solving the Problems

Inventors of the present invention carried out an extensive investigation to achieve the object mentioned above; and as a result, it was found that the said object could be achieved effectively by using a base oil which contained a mineral oil having a high viscosity index and endowed with specific properties and composition. The present invention could be completed by such information.

Namely, the present invention provides:

1. a lubricating oil composition wherein a base oil which contains a mineral oil satisfying flowing conditions (1) to (3) is used:
   (1) kinetic viscosity at 100° C. is in the range of 5 $mm^2/s$ or more to 8 $mm^2/s$ or less,
   (2) viscosity index is 130 or more, and
   (3) % $C_P$ by a ring analysis (n-d-M method) is 80 or more,
2. the lubricating oil composition according to 1, wherein the viscosity index of the mineral oil is 160 or less,
3. the lubricating oil composition according to 1 or 2, wherein in the mineral oil, % $C_P$ is in the range of 80 or more to 95 or less, % $C_N$ is in the range of 5 or more to 20 or less, and % $C_A$ is 1.0 or less,
4. the lubricating oil composition according to any of 1 to 3, wherein the kinetic viscosity at 100° C. of the mineral oil is in the range of 5.5 $mm^2/s$ or more to 7.5 $mm^2/s$ or less,
5. the lubricating oil composition according to any of 1 to 4, wherein the said lubricating oil composition uses the base oil which contains, in addition to (A) the mineral oil, (B) one or more base oils selected from (b1) a mineral oil having a kinetic viscosity at 100° C. in the range of 1.5 $mm^2/s$ or more to 4.5 $mm^2/s$ or less and a pour point of −25° C. or lower and (b2) a synthetic oil having a kinetic viscosity at 100° C. in the range of 1.5 $mm^2/s$ or more to 6.5 $mm^2/s$ or less and a pour point of −30° C. or lower,
6. the lubricating oil composition according to 5, wherein the base oil comprising the component (A) in the range of 40% or more by mass to 75% or less by mass and the component (B) in the range of 25% or more by mass to 60% or less by mass based on total amount of the base oil is used,
7. the lubricating oil composition according to any of 1 to 6, wherein in entirety of the base oil, % $C_P$ is in the range of 80 or more to 95 or less, % $C_N$ is in the range of 5 or more to 20 or less, and % $C_A$ is 1.0 or less,
8. the lubricating oil composition according to any of 1 to 7, wherein the said lubricating oil composition contains at least one lubricating oil additive selected from an antioxidant, an extreme pressure agent or an anti-wear agent, a dispersant, a metallic detergent, an oiliness improver, a rust inhibitor, a metal deactivator, a corrosion inhibitor, a pour point depressant, and a defoaming agent, and 9. the lubricating oil composition according to any of 1 to 8, wherein the said lubricating oil composition is a lubricating oil composition for an automatic transmission.

Effect of the Invention

According to the present invention, provided is a lubricating oil composition suitable as a transmission oil; the composition having a low friction coefficient (traction coefficient) and a superior fluidity at low temperature.

MODE FOR CARRYING OUT THE INVENTION

The lubricating oil composition of the present invention is the lubricating oil composition using a base oil which contains a mineral oil having a high viscosity index and endowed with specific properties and composition.

Base Oil:

The mineral oil having a high viscosity index has the properties and the composition shown by the following (1) to (3).

(1) The kinetic viscosity at 100° C. is in the range of 5 $mm^2/s$ or more to 8 $mm^2/s$ or less.

When the mineral oil having less than 5 $mm^2/s$ as the kinetic viscosity at 100° C. is used in the base oil, an oil film cannot be formed adequately on a sliding surface; and thus, a lubricating oil composition having a low friction coefficient cannot be obtained. On the other hand, when the mineral oil having more than 8 $mm^2/s$ as the kinetic viscosity at 100° C. is used in the base oil, an energy loss due to increase in fluid resistance becomes larger. Accordingly, the kinetic viscosity at 100° C. of the mineral oil having a high viscosity index is preferably in the range of 5.5 $mm^2/s$ or more to 7.5 $mm^2/s$ or less, or more preferably in the range of 6.0 $mm^2/s$ or more to 7.0 $mm^2/s$ or less.

(2) The viscosity index is 130 or more.

When the viscosity index is less than 130, it becomes difficult to maintain the viscosity in an appropriate level in a wide range of temperature and the abrasion resistance and the friction coefficient in good conditions. In addition, there is a fear that sufficient fluidity at low temperature may not be obtained. Accordingly, the viscosity index of the mineral oil having a high viscosity index is preferably 135 or more, or more preferably 140 or more. On the other hand, in order to keep good stability of the composition's solubility, the upper limit of the viscosity index is preferably 160 or less, though there is no particular restriction. If the stability of solubility is good, the effects to fully express the performances possessed by each of the base oils to constitute the composition may be obtained.

(3) The % $C_P$ by the ring analysis (n-d-M method) is 80 or more

As to the composition of the base oil of the lubricating oil to be used in the present invention, it is necessary that the % $C_P$ be 80 or more. If the % $C_P$ is less than 80, a composition satisfying necessary properties including a high viscosity index, a low friction coefficient (traction coefficient), and a superior fluidity at low temperature cannot be obtained. Accordingly, the % $C_P$ is preferably 83 or more, or more preferably 85 or more.

On the other hand, the upper limit of the % $C_P$ is preferably 95 or less. If the % $C_P$ is 95 or less, the sum of the % $C_N$ and the % $C_A$ becomes 5 or more, so that the stability of the composition's solubility may be kept in a good condition. Accordingly, the % $C_P$ is more preferably 90 or less.

In addition, in order to enhance the oxidation stability, the % $C_A$ is preferably 1.0 or less, or more preferably 0.5 or less.

Therefore, composition of the mineral oil having a high viscosity index used in the present invention is preferably in the range of 80 or more to 95 or less for the % $C_P$, in the range of 5 or more to 20 or less for the % $C_N$, and 1.0 or less for the % $C_A$; or more preferably in the range of 80 or more to 90 or less for the % $C_P$, in the range of 10 or more to 20 or less for the % $C_N$, and 1.0 or less for the % $C_A$.

By containing the mineral oil having a high viscosity index and endowed with the composition as mentioned above, the composition having a high viscosity index, a low traction coefficient, a superior fluidity at low temperature, and an excellent stability in solubility can be obtained.

In addition, as to the afore-mentioned mineral oil having a high viscosity index, the mineral oil further having the following properties are more preferable.

Pore point is −12.5° C. or lower, or further, −15.0° C. or lower.

Flash point is 240° C. or higher.

Content of sulfur is 20 or less ppm by mass, or further, 10 or less ppm by mass.

The mineral oil having a high viscosity index to be used in the present invention may be produced by isomerization of a wax.

Specifically, for example, a wax or a wax fraction including a slack wax is used as the wax raw material; and, this is isomerized by a usual way by using an isomerization catalyst such as, for example, a catalyst in which Pt or Pd is supported on a carrier mainly comprising silica, alumina, or zeolite, a catalyst in which one metal component or more selected from Ni, Co, Mo, W, and the like is supported on a carrier mainly comprising alumina and silica, whereby obtaining an isomerized product. Usually this isomerized product is further distilled under reduced pressure, and followed by a dewaxing treatment if necessary.

The base oil to be used in the present invention contains the above-mentioned mineral oil having a high viscosity index (hereinafter, this is referred to as "base oil A").

Specifically, content of the base oil A is preferably 20% or more by mass, more preferably 30% or more by mass, or particularly preferably 40% or more by mass, based on the total amount of the base oil. In other words, the base oil comprising only the base oil A may be allowed. If the content of the base oil A is 20% or more by mass in the base oil, a composition satisfying the afore-mentioned effects of the base oil A including a high viscosity index and a low friction coefficient may be obtained.

The base oil of the present invention may contain, together with the base oil A, other base oil than the base oil A (hereinafter, this is referred to as "base oil B"). As to the base oil B, one or more kinds of a mineral oil may be used, one or more kinds of a synthetic oil may be used, or a mixture of one or more kinds of a mineral oil with one or more kinds of a synthetic oil may be used.

As to the base oil B, it is preferable to use one or more kinds selected from (b1) a low-viscosity mineral oil and (b2) a low-viscosity synthetic oil. By adding the base oil B like this to the base oil A, the fluidity of the base oil at low temperature may be further enhanced.

As to (b1) the low-viscosity mineral oil, preferably used is a mineral oil having, as the kinetic viscosity at 100° C., preferably in the range of 1.5 $mm^2/s$ or more to 4.5 $mm^2/s$ or lower, or more preferably in the range of 2.0 $mm^2/s$ or more to 4.0 $mm^2/s$ or lower, and as the pour point, −25° C. or lower, preferably −27.5° C. or lower, or particularly preferably −30° C. or lower.

More preferable embodiment of (b1) the low viscous mineral oil is that the viscosity index is 90 or more, the flash point is 140° C. or higher, and the sulfur content is 20 or less ppm by mass.

(b1) The low viscous mineral oil may be exemplified specifically by mineral oils, so-called 60 neutral mineral oil and 70 neutral mineral oil. Among them, 60 neutral mineral oil is preferable because it has a low pour point.

On the other hand, as to (b2) the low-viscosity synthetic oil, preferably used is a synthetic oil having, as the kinetic viscosity at 100° C., preferably in the range of 1.5 $mm^2/s$ or more to 6.5 $mm^2/s$ or lower, or more preferably in the range of 1.7 $mm^2/s$ or more to 6.2 $mm^2/s$ or lower, and as the pour point, −30° C. or lower, preferably −40° C. or lower, or particularly preferably −50° C. or lower.

More preferable embodiment of the low-viscosity synthetic oil is that the viscosity index is 100 or more and the flash point is 140° C. or higher.

The low-viscosity synthetic oil as mentioned above may be exemplified specifically by a poly(α-olefin) which is an oligomer of an α-olefin having 8 to 14 carbon atoms such as, for example, 1-decene. This poly(α-olefin) is usually used as the hydrogenated poly(α-olefin).

Besides, included in the poly(α-olefin) are the poly(α-olefin) obtained by oligomerization by using a metallocene catalyst and the hydrogenated product thereof.

Among them, because of a high viscosity index and an easy availability, the poly(α-olefin) (hydrogenated) which is an oligomer of 1-decene is preferable; and especially the poly(α-olefin) (hydrogenated) which is obtained by using a metallocene catalyst is more preferable.

In the present invention, if one or more kinds selected from (b1) the low-viscosity mineral oil and (b2) the low-viscosity synthetic oil are used as the base oil B, the blending ratio of the base oil A and the base oil B based on the total of the base oils is preferably in the range of 40% or more by mass to 75% or less by mass for the base oil A, and in the range of 25% or more by mass to 60% or less by mass for the base oil B; or more preferably in the range of 45% or more by mass to 72% or less by mass for the base oil A, and in the range of 28% or more by mass to 55% or less by mass for the base oil B.

In addition, if a mixture of (b1) the low-viscosity mineral oil and (b2) the low-viscosity synthetic oil is used as the base oil B, the mixing ratio therebetween is not particularly restricted but arbitral; however, it is preferable that based on the total amount of the base oil B, (b1) the low-viscosity mineral oil be in the range of 25% or more by mass to 75% or less by mass and (b2) the low-viscosity synthetic oil be in the range of 75% by mass to 25% by mass.

In the lubricating oil composition of the present invention, the base oil A or the base oil comprising the base oil A and the other base oil B is used, wherein composition of the base oil, i.e., composition of the entire base oil, is preferably in the range of 80 or more to 95 or less for the % $C_P$, in the range of 5 or more to 20 or less for the % $C_N$, and 1.0 or less for the % $C_A$. Therefore, if the base oil containing, along with the base oil A, the other base oil B is used, it is preferable to select the other base oil B in such a way as to give this composition.

Composition of the base oil is more preferably in the range of 80 or more to 90 or less for the % $C_P$, in the range of 10 or more to 20 or less for the % $C_N$, and 1.0 or less for the % $C_A$.

In the lubricating oil composition of the present invention, a base oil other than the base oil A and the base oil B may be added into the base oil A or into the base oil comprising the base oil A and the other base oil B; and moreover, a lubricating oil additive may be added thereinto as the component (C).

Illustrative example of the component (C) includes (c1) an antioxidant, (c2) an extreme pressure agent or an anti-wear agent, (c3) a dispersant, and (c4) a metallic detergent; and it is preferable to add one or two or more of the lubricating oil additives selected from them into the composition.

Illustrative example of (c1) the antioxidant includes an amine type antioxidant, a phenol type antioxidant, and a sulfur type antioxidant.

The amine type antioxidant may be exemplified by dialkyl diphenylamines (alkyl group having 1 to 20 carbon atoms) such as 4,4'-dibutyl diphenylamine, 4,4'-dioctyl diphenylamine, and 4,4'-dinonyl diphenylamine; and naphthylamines such as phenyl-α-naphthylamine, octylphenyl-α-naphthylamine, and nonyl-α-naphthylamine.

The phenol type antioxidant may be exemplified by monophenol type antioxidants such as 2,6-di-tert-butyl-4-methylphenol and 2,6-di-tert-butyl-4-ethylphenol; and diphenol type antioxidants such as 4,4'-methylenebis(2,6-di-tert-butylphenol) and 2,2'-methylenebis(4-ethyl-6-tert-butylphenol).

The sulfur type antioxidant may be exemplified by phenothiazine, pentaerythritol-tetrakis-(3-laurylthiopropionate), bis(3,5-tert-butyl-4-hydroxybenzyl)sulfide, thiodiethylene bis(3-(3,5-di-tert-butyl-4-hydroxyphenyl)) propionate, and 2,6-di-tert-butyl-4-(4,6-bis(octylthio)-1,3,5-triazine-2-methylamino)phenol.

These antioxidants may be used solely or as a combination of two or more of them. The blending amount thereof is selected usually in the range of 0.01% or more by mass to 10% or less by mass, or preferably in the range of 0.03% or more by mass to 5% or less by mass, based on the total amount of the lubricating oil composition.

Illustrative example of (c2) the extreme pressure agent or the anti-wear agent includes a sulfur type extreme pressure agent, a phosphorous type anti-wear agent, a S-P type extreme pressure agent, a zinc dihydrocarbyl dithiophosphate, and a thiazole type extreme pressure agent.

The sulfur type extreme pressure agent may be exemplified by a sulfurized fatty oil, a sulfurized fatty acid, a sulfurized ester, a sulfurized olefin, a dihydrocarbyl polysulfide, a thiadiazole compound, an alkyl thiocarbamoyl compound, a thiocarbamate compound, a thioterpene compound, a dialkyl thiodipropionate compound, and the like.

The phosphorous type anti-wear agent may be exemplified by phosphate esters including a phosphate ester, an acidic phosphate ester, a phosphite ester, and an acidic phosphite ester; and amine salts of these phosphate esters.

As to the S-P type extreme pressure agent, a compound containing both sulfur and phosphorous in the same molecule such as, for example, thiophosphate esters including triphenyl thiophosphate and lauryl trithiophosphite may be used; or a mixture of a sulfur type extreme pressure agent and a phosphorous type extreme pressure agent may be used as well. If a sulfur type extreme pressure agent and a phosphorous type extreme pressure agent are mixed, each of the sulfur type extreme pressure agent and the phosphorous type anti-wear agent that are mentioned above as the sulfur type extreme pressure agent and the phosphorous type extreme pressure agent may be used.

The zinc dihydrocarbyl dithiophosphate (ZnDTP) may be exemplified by those having the hydrocarbyl group which is any of a linear or a branched alkyl group having 1 to 24 carbon atoms, a linear or a branched alkenyl group having 3 to 24 carbon atoms, a cycloalkyl or a linear or a branched alkyl cycloalkyl group having 5 to 13 carbon atoms, an aryl or a linear or a branched alkyl aryl group having 6 to 18 carbon atoms, an arylalkyl group having 7 to 19 carbon atoms, and the like. In addition, these alkyl groups and alkenyl groups may be any of primary, secondary, and tertiary.

The thiadizole type extreme pressure agent may be exemplified by 2,5-bis(n-hexyldithio)-1,3,4-thiadiazole, 2,5-bis(n-octyldithio)-1,3,4-thiadiazole, 2,5-bis(n-nonyldithio)-1,3,4-thiadiazole, 2,5-bis(1,1,3,3-tetramethylbutyldithio)-1,3,4-thiadiazole, 3,5-bis(n-hexyldithio)-1,2,4-thiadiazole, 3,6-bis(n-octyldithio)-1,2,4-thiadiazole, 3,5-bis(n-nonyldithio)-1,2,4-thiadiazole, 3,5-bis(1,1,3,3-tetramethylbutyldithio)-1,2,4-thiadiazole, 4,5-bis(n-octyldithio)-1,2,3-thiadiazole, 4,5-bis(n-nonyldithio)-1,2,3-thiadiazole, 4,5-bis(1,1,3,3-tetramethylbutyldithio)-1,2,3-thiadiazole, and the like.

These extreme pressure agents or anti-wear agents may be used solely or as a combination of two or more of them. The blending amount thereof is selected usually in the range of 0.01% or more by mass to 10% or less by mass, or preferably in the range of 0.05% or more by mass to 5% or less by mass, based on the total amount of the lubricating oil composition.

Illustrative example of (c3) the dispersant includes an imide type dispersant, an amide type dispersant, and an ester type dispersant.

Specific example thereof includes an alkenyl-substituted alkenyl succinimide having average molecular weight in the range of 1000 or more to 3500 or less and a borate compound thereof, benzylamine, an alkyl polyamine, and an alkenyl succinate ester.

These dispersants may be used solely or as a combination of two or more of them. The blending amount thereof is selected usually in the range of 0.05% or more by mass to 10% or less by mass, or preferably in the range of 0.1% or more by mass to 5% or less by mass, based on the total amount of the lubricating oil composition.

Illustrative example of (c4) the metallic detergent includes an sulfonate, a phenate, an salicylate, a phosphonate, and the like of alkaline earth metals including Ca, Mg, and Ba. These may be any of neutral compound, basic compound, and perbasic compound.

These metallic detergents may be used solely or as a combination of two or more of them. The blending amount thereof is selected usually in the range of 0.05% or more by mass to 30% or less by mass, or preferably in the range of 0.1% or more by mass to 10% or less by mass, based on the total amount of the lubricating oil composition.

As to the lubricating oil additive, besides the above-mentioned additives, an oiliness improver, a rust inhibitor, a metal deactivator, a corrosion inhibitor, a pour point depressant, a defoaming agent, and the like may be arbitrarily blended with the composition.

Usually, the total blending amount of the lubricating oil additives in the present invention is preferably in the range of 1 or more parts by mass to 20 or less parts by mass, or more preferably in the range of 3 or more parts by mass to 15 or less parts by mass, relative to 100 parts by mass of the sum of the components (A) and (B).

Lubricating Oil Composition:

The lubricating oil composition of the present invention is, as discussed above, the composition contains the base oil including the base oil A, especially the base oil containing the base oil A and the base oil B, and if necessary, those lubricating oil additives.

The viscosity index of the lubricating oil composition is preferably 160 or more, or more preferably 165 or more. There is no upper limit in the viscosity index; but it is preferably 190 or less, or more preferably 180 or less.

The kinetic viscosity of the lubricating oil composition of the present invention is not particularly restricted; and thus, it may be selected arbitrarily in accordance with the application and use conditions of the lubricating oil composition.

For example, if the lubricating oil composition is used as the lubricating oil composition for an automatic transmission of an automobile, the kinetic viscosity at 100° C. is preferably in the range of 5.58 $mm^2/s$ or more to 8 $mm^2/s$ or less, or more preferably in the range of 6.08 $mm^2/s$ or more to 7.0 $mm^2/s$ or less.

The lubricating oil composition of the present invention is used as a lubricating oil for an automobile transmission and for other transmissions. Illustrative example of the other transmission includes a manual transmission, an automobile gear, a continuously variable transmission, an industrial gear, and the like.

EXAMPLES

Next, the present invention will be explained in more detail by Examples; however, the present invention is not restricted at all by these Examples.

Examples 1 to 3 and Comparative Examples 1 to 2

Each of the lubricating oil compositions having the compositions shown in Table 1 was prepared by using each of the base oils shown in Table 1; and properties, the traction coefficients, and the viscosities at low temperatures of them were measured.

Properties and performances of the mineral oils, the synthesis oils, and the lubricating oil compositions were measured by the methods shown below.

Measurement methods of properties of the mineral oils, the synthesis oils, and the lubricating oil compositions:

(1) Kinetic Viscosity

Measurement was done in accordance with JIS K2283.

(2) Viscosity Index

Measurement was done in accordance with JIS K2283.

(3) Pour Point

Measurement was done in accordance with JIS K2269.

Evaluation methods of performances of the mineral oils, the synthesis oils, and the lubricating oil compositions:

(4) Composition Analysis

In accordance with ASTM D3238, the % $C_P$, the % $C_N$, and the % $C_A$ were measured by the ring analysis method (n-d-M method).

(5) CCS Viscosity

The viscosity at −30° C. was measured in accordance with JIS K2010 (unit of CCS viscosity: mPa·s).

(6) Viscosity at Low Temperature (BF Viscosity)

The viscosity at −40° C. was measured in accordance with ASTM D2983 (unit of BF viscosity: mPa·s).

(7) Traction Coefficient

The traction coefficient was measured by the following test instrument and measurement conditions.

Test Instrument:

Mini Traction Machine (manufactured by PCS Instruments Limited)

Measurement Conditions:

Ball: Diameter of 19.05 mm, made of the AISI 52100 bearing steel

Disk: Diameter of 50 mm, made of the AISI 52100 bearing steel

Rolling velocity: 2.0 m/s

Load: 45 N

Oil temperature: 100° C.

Slide-roll ratio (SRR): 50%

TABLE 1

| | | | Example 1 | Example 2 | Example 3 | Comparative Example 1 | Comparative Example 2 |
|---|---|---|---|---|---|---|---|
| Blending ratio (% by mass) | Base oil | Base oil A [1)] | 61.86 | 37.50 | 37.50 | — | — |
| | | Base oil B (mineral oil) [2)] | — | — | — | — | 48.20 |
| | | Base oil C (mineral oil) [3)] | — | — | — | — | 39.80 |
| | | Base oil D (mineral oil) [4)] | — | — | — | 67.52 | — |
| | | Base oil E (mineral oil) [5)] | 26.14 | 17.37 | 17.37 | 20.48 | — |
| | | Base oil F (synthetic oil) [6)] | — | — | 22.50 | — | — |
| | | Base oil G (synthetic oil) [7)] | — | 22.50 | — | — | — |
| | Additive | ATF additive-1 [8)] | 11.97 | — | — | 11.97 | 11.97 |
| | | ATF additive-2 [9)] | — | 22.60 | 22.60 | — | — |
| | | Colorant [10)] | 0.03 | 0.03 | 0.03 | 0.03 | 0.03 |
| Composition of base oil | | % $C_P$ | 83.3 | 88.0 | 88.0 | 77.7 | 77.2 |
| | | % $C_N$ | 16.4 | 11.8 | 11.8 | 21.7 | 22.8 |
| | | % $C_A$ | 0.3 | 0.2 | 0.2 | 0.6 | 0.0 |
| Kinetic viscosity 40° C. ($mm^2/s$) | | | 28.46 | 28.27 | 27.98 | 30.20 | 29.91 |
| Kinetic viscosity 100° C. ($mm^2/s$) | | | 6.066 | 6.171 | 6.135 | 6.151 | 6.032 |
| Viscosity index | | | 168 | 176 | 177 | 128 | 154 |
| CCS viscosity −30° C. (mPa • s) | | | 2060 | 1850 | 1760 | 2440 | 2870 |
| BF viscosity −40° C. (mPa • s) | | | 8940 | 6630 | 5950 | 10300 | 9900 |
| Traction coefficient (oil temperature 100° C.) | | | 0.035 | 0.034 | 0.033 | 0.039 | 0.042 |

Notes:

[1)] Base oil A: 150 neutral mineral oil, kinetic viscosity at 100° C.: 6.4 $mm^2/s$, kinetic viscosity at 40° C.: 34.07 $mm^2/s$, viscosity index: 143, % $C_P$: 86.3, % $C_N$: 13.3, % $C_A$: 0.4, pour point: −15.0° C., flash point: 244° C., and sulfur content: less than 10 ppm by mass.

[2)] Base oil B: 150 neutral mineral oil, kinetic viscosity at 100° C.: 6.5 $mm^2/s$, kinetic viscosity at 40° C.: 36.82 $mm^2/s$, viscosity index: 131, % $C_P$: 77.0, % $C_N$: 23.0, % $C_A$: 0.0, pour point: −12.5° C., flash point: 240° C., and sulfur content: less than 10 ppm by mass.

[3)] Base oil C: 70 neutral mineral oil, kinetic viscosity at 100° C.: 3.1 $mm^2/s$, kinetic viscosity at 40° C.: 12.53 $mm^2/s$, viscosity index: 109, % $C_P$: 77.4, % $C_N$: 22.6, % $C_A$: 0.0, pour point: −27.5° C., flash point: 196° C., and sulfur content: less than 10 ppm by mass.

[4)] Base oil D: 150 neutral mineral oil, kinetic viscosity at 100° C.: 6.3 $mm^2/s$, kinetic viscosity at 40° C.: 35.52 $mm^2/s$, viscosity index: 129, % $C_P$: 78.1, % $C_N$: 21.1, % $C_A$: 0.8, pour point: −20.0° C., flash point: 252° C., and sulfur content: less than 10 ppm by mass.

[5)] Base oil E: 60 neutral mineral oil, kinetic viscosity at 100° C.: 2.2 $mm^2/s$, kinetic viscosity at 40° C.: 7.12 $mm^2/s$, viscosity index: 109, % $C_P$: 76.2, % $C_N$: 23.7, % $C_A$: 0.1, pour point: −37.5° C., flash point: 158° C., and sulfur content: less than 10 ppm by mass.

[6)] Base oil F: hydrogenated 1-decene oligomer by a metallocene catalyst, kinetic viscosity at 100° C.: 6.0 $mm^2/s$, kinetic viscosity at 40° C.: 31.0 $mm^2/s$, viscosity index: 143, and % $C_P$: 100.

[7)] Base oil G: hydrogenated 1-decene oligomer, kinetic viscosity at 100° C.: 1.8 $mm^2/s$, kinetic viscosity at 40° C.: 5.10 $mm^2/s$, viscosity index: 128, % $C_P$: 100, and pour point: −70.0° C.

[8)] Package additive containing an S-type extreme agent and a P-type anti-wear agent (trade name of HiTEC 3491K; manufactured by Afton Chemical Corp.).

[9)] Package additive containing an S-type extreme agent and a P-type anti-wear agent (trade name of HiTEC 3491A; manufactured by Afton Chemical Corp.).

[10)] Red colorant.

From Table 1, the followings can be seen.

In the lubricating oil composition using the base oil of the present invention, the viscosity index is so high with the value of 160 or more, and the friction coefficient (traction coefficient) is extremely small with the value of 0.035 or less. At the same time, the viscosities at the low temperatures (CCS viscosity at −30° C. and BF viscosity at −40° C.) are low. Accordingly, it can be seen that not only the friction coefficient is low and the anti-wear resistance is excellent, but also the fluidity at low temperature is excellent (Examples 1 to 3).

On the contrary, in both the lubricating oil composition of Comparative Example 1 in which the mineral oil not satisfying the % $C_P$ of 80 is used and the lubricating oil composition of Comparative Example 2 in which the mineral oil not satisfying both the % $C_P$ and the viscosity index is used, the traction coefficients are high (0.039 and 0.042) and the viscosities at the low temperatures are high. Accordingly, both of them cannot achieve the object of the present invention.

INDUSTRIAL APPLICABILITY

According to the present invention, the lubricating oil composition having a low friction coefficient (traction coefficient) and a superior fluidity at low temperature can be provided. Therefore, this may be advantageously used in a wide region including especially a cold weather region as the lubricating oil composition for a transmission oil including an automatic transmission oil endowed with a low energy consumption.

The invention claimed is:

1. A lubricating oil composition, comprising a base oil, wherein the base oil comprises:

(A) a mineral oil satisfying conditions (1) to (3):

(1) kinetic viscosity at 100° C. is in the range of 5 $mm^2/s$ or more to 8 $mm^2/s$ or less;

(2) viscosity index is 130 or more; and (3) % $C_P$ by a ring analysis (n-d-M method) is 80 or more;

(B-1) a mineral oil having a kinetic viscosity at 100° C. in the range of 1.5 $mm^2/s$ or more to 4.5 $mm^2/s$ or less and a pour point of −25° C. or lower; and (B-2) a synthetic oil having a kinetic viscosity at 100° C. in the range of 1.5 $mm^2/s$ or more to 6.5 $mm^2/s$ or less and a pour point of −30° C. or lower, and the lubricating oil composition is adapted to function as an oil for a transmission.

2. The lubricating oil composition according to claim 1, wherein the viscosity index of the mineral oil (A) is 160 or less.

3. The lubricating oil composition according to claim 1, wherein in the mineral oil (A):

% $C_P$ is in the range of 80 or more to 95 or less;

% $C_N$ is in the range of 5 or more to 20 or less; and

% $C_A$ is 1.0 or less.

4. The lubricating oil composition according to claim 1, wherein the kinetic viscosity at 100° C. of the mineral oil (A) is in the range of 5.5 $mm^2/s$ or more to 7.5 $mm^2/s$ or less.

5. The lubricating oil composition according to claim 1, wherein:

the mineral oil (B-1) has a kinetic viscosity at 100° C. in the range of 2.0 $mm^2/s$ or more to 4.0 $mm^2/s$ or less and a pour point of −25° C. or lower; and the synthetic oil (B-2) has a kinetic viscosity at 100° C. in the range of 1.7 $mm^2/s$ or more to 6.2 $mm^2/s$ or less and a pour point of −30° C. or lower.

6. The lubricating oil composition according to claim 5, wherein the base oil comprises:

40% or more to 75% or less by mass of the mineral oil (A); and

25% or more to 60% or less by mass of a combined mass of the mineral oil (B-1) and the synthetic oil (B-2), based on a total mass of the base oil.

7. The lubricating oil composition according to claim 1, wherein in an entirety of the base oil:

% $C_P$ is in the range of 80 or more to 95 or less;

% $C_N$ is in the range of 5 or more to 20 or less; and

% $C_A$ is 1.0 or less.

8. The lubricating oil composition according to claim 1, further comprising at least one additive selected from the group consisting of an antioxidant, an extreme pressure agent, an anti-wear agent, a dispersant, a metallic detergent, an oiliness improver, a rust inhibitor, a metal deactivator, a corrosion inhibitor, a pour point depressant, and a defoaming agent.

9. An automatic transmission, comprising the lubricating oil composition of claim 1.

10. A lubricating oil composition, comprising a base oil, wherein the base oil comprises:

(A) a mineral oil satisfying conditions (1) to (3):

(1) kinetic viscosity at 100° C. is in the range of 5 $mm^2/s$ or more to 8 $mm^2/s$ or less;

(2) viscosity index is 130 or more; and (3) % $C_P$ by a ring analysis (n-d-M method) is 80 or more;

(B) at least one base oil selected from the group consisting of (b1) a mineral oil having a kinetic viscosity at 100° C. in the range of 1.5 $mm^2/s$ or more to 4.5 $mm^2/s$ or less and a pour point of −30° C. or lower, and (B-2) a synthetic oil having a kinetic viscosity at 100° C. in the range of 1.5 $mm^2/s$ or more to 6.5 $mm^2/s$ or less and a pour point of −30° C. or lower, and the lubricating oil composition is adapted to function as an oil for a transmission.

* * * * *